United States Patent [19]

Bardsley

[11] 4,030,676

[45] June 21, 1977

[54] PORTABLE HOLDER FOR ROLL OF PERFORATED PAPER TOWEL

[76] Inventor: James G. Bardsley, Rte. 1, Box 645, Sutter Creek, Calif. 95685

[22] Filed: Jan. 29, 1976

[21] Appl. No.: 653,452

[52] U.S. Cl. ..... 242/55.54

[51] Int. Cl.[2] ..... A47K 10/16

[58] Field of Search ..... 242/55.54, 55.42, 55.2, 242/55.55, 55.53; 225/82, 93, 96.5, 106, 2

[56] References Cited

UNITED STATES PATENTS

| | | | |
|---|---|---|---|
| 1,224,106 | 4/1917 | Good | 242/55.54 |
| 2,555,531 | 6/1951 | Boord | 242/55.42 |
| 3,622,010 | 11/1971 | Renelt | 242/55.54 |
| 3,941,325 | 3/1976 | Krause | 242/55.54 |

*Primary Examiner*—George F. Mautz

*Attorney, Agent, or Firm*—Leslie M. Hansen

[57] ABSTRACT

A pedestal type holder for rolled paper towelling perforated for tear-off as individual sheets and transportable for support on any horizontal surface, the holder having a base with upstanding pole to receive and support the roll of towelling on a vertical axis, the base being provided with an annular rim circumscribing the lower portion of the roll of towelling and having an inner annular edge upwardly from the base engageable by a sheet of towelling extending tangentially from the roll to provide a fulcrum point on such extended sheet offset from the roll affording a starting break off of such sheet from the roll along a line of perforations therebetween and a gradual separation thereof upon downward manipulation of such extended sheet relative to the holder and roll of towelling thereon.

4 Claims, 5 Drawing Figures

PORTABLE HOLDER FOR ROLL OF PERFORATED PAPER TOWEL

BACKGROUND OF THE INVENTION

This invention relates to a roll holder and more particularly to a table top or counter top portable holder for supporting a roll of paper towels and the like.

The roll holder embodying the present invention is specifically contrived for supporting a conventional roll of paper provided as a continuous ribbon of paper towelling perforated for detachment one or several segments at a time from the roll into individual hand towels.

Holders for such conventional paper towelling are shown in U.S. Pat. No. 3,407,980 to Addison as well as U.S. Pat. No. 3,806,057 to Whatley. In each of these prior disclosures the holder must be secured to a wall, shelf or countertop in order to facilitate tear-off of individual segments from the roll supported by such prior known holders. In the absence of being thus secured neither of these prior devices facilitate the tear-off of individual paper towels as contemplated by the invention having its embodyment in the holder of the present application.

STATEMENT OF THE INVENTION

It is an object of the present invention to provide a portable towel holder adapted for free standing condition on a horizontal surface yet enabling ease of detachment of individual segments from the roll of towels thus supported.

It is another object to provide a portable holder for supporting conventional paper towelling rolled upon an elongated tubular core in such a manner as to enable a person to detach an individual segment from such roll by the use of one hand only, gripping the top corner of the first free segment and exherting a pull against the perforation adjacent such corner to thereby gradually tear-off such segment along such line of perforation.

In conjunction with the foregoing object it is a further object to provide the portable holder with a pole or standard supported in a vertical position from a base having an annular pit circumscribing the pole and the roll of paper towelling supported spindle fashion thereon, the pit being of sufficient depth to embrace the lower portion of the roll of towelling to stabilize the latter during the tearng off of an individual segment therefrom as stated above.

These and other objects and advantages of the present invention will become apparent from a reading of the following description and claims in the light of the accompanying single sheet of drawing in which:

FIG. 3 is a plan view similar to that of FIG. 2 with the towel roll removed and the center spindle cut through;

GENERAL DESCRIPTION

Figure 1:
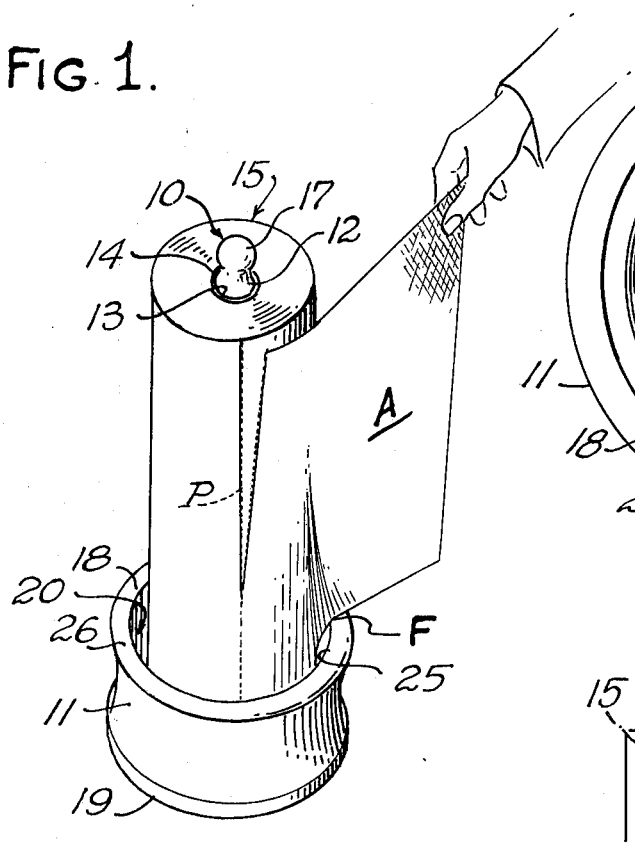
FIG. 1 shows the towel holder in use.
Figure 2:
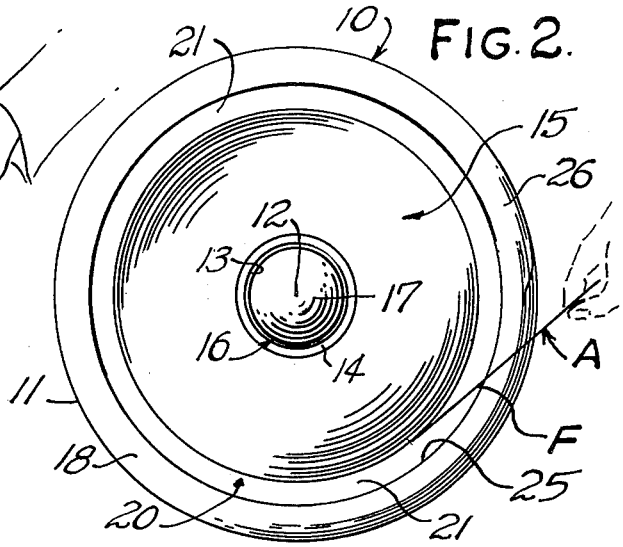
FIG. 2 is a top plan view of FIG. 1 at enlarged scale with respect thereto.
Figure 3:
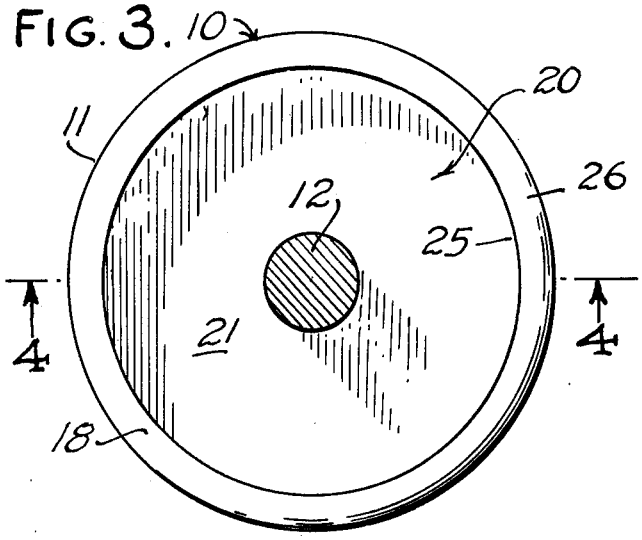

Referring to the drawing, the holder of the present invention designated 10, includes a pedestal type of base 11 from which a pole 12 extends upwardly in the form of a vertical spindle having a diameter adapted to be received in the hollow center 13 of the rigid tubular core 14 of a conventional roll of paper towelling 15. The pole or spindle 12 is of a length comparable to that of the tubular core 14 and roll of paper towelling 15 thereon for supporting the latter with its axis vertical upon the spindle 12.

DETAILED DESCRIPTION OF THE INVENTION

In accordance with the present invention the holder 10 is portable. That is, free to be moved about for support on any horizontal surface wherever the paper towelling 15 is needed. For this reason the spindle pole 12 may extend slightly beyond the upper end of the roll of towelling 15 supported thereon to provide a handle 16 for the holder 10. The handle 16 is preferably in the form of a knob 17 to facilitate the ease of gripping the same in the fingers of one human hand and for carrying the holder with the roll of towelling supported thereon from place to place as needed.

The base 11 of the holder 10 embodying the present invention has thickness such that the upper surface 18 of the base is spaced from its bottom surface 19 to provide for a recess 20 concentric to the towel supporting spindle 12. The recess 20 is formed in the base 11 to a depth substantially comparable to the diameter of the spindle or pole 12 and to provide a platform 21 perpendicular to the pole and upon which the bottom edge of a roll of paper towelling 15 rests while being supported spindle fashion on the horizontal pole 12. By this arrangement the roll of paper towelling 15 has its lower edge stabilized normal to the base and its upper edge secured vertically above the base by the upstanding pole 12. Under normal circumstances such arrangement might seem to be sufficient to support the vertically disposed roll of towelling during the separation of a first or second free segment of towelling along a line of perforation P. Logical as this may seem to be true, it is not so unless the base 11 is made heavy enough or the pole 12 supported vertically by hand to withstand the pull against the first free sheet to cause the separation thereof along its adjacent line of perforations P. After experiencing the foregoing deficiency it was discovered that by providing a fulcrum point upwardly from or above the bottom edge of the upstanding roll of towelling a sufficient distance above the base platform 21 a slight pull upon the upper outer corner of the first free segment of towelling resulted in a gradual severance thereof along the line of perforations P. Such fulcrum point is provided by an upper annular edge 25 of the rim 26 of the recess 20 formed in the upper surface 18 of the base 11.

The annular edge 25 being disposed upwardly from the platform 21 a distance substantially comparable to the diameter of the pole 12, it will be appreciated that the bottom edge of a sheet of towel extending tangiently from the roll thereof will engage the edge 25 in spaced relation to the line of perforations P as the sheet segment is about to be torn off (FIG. 1).

Figure 4:
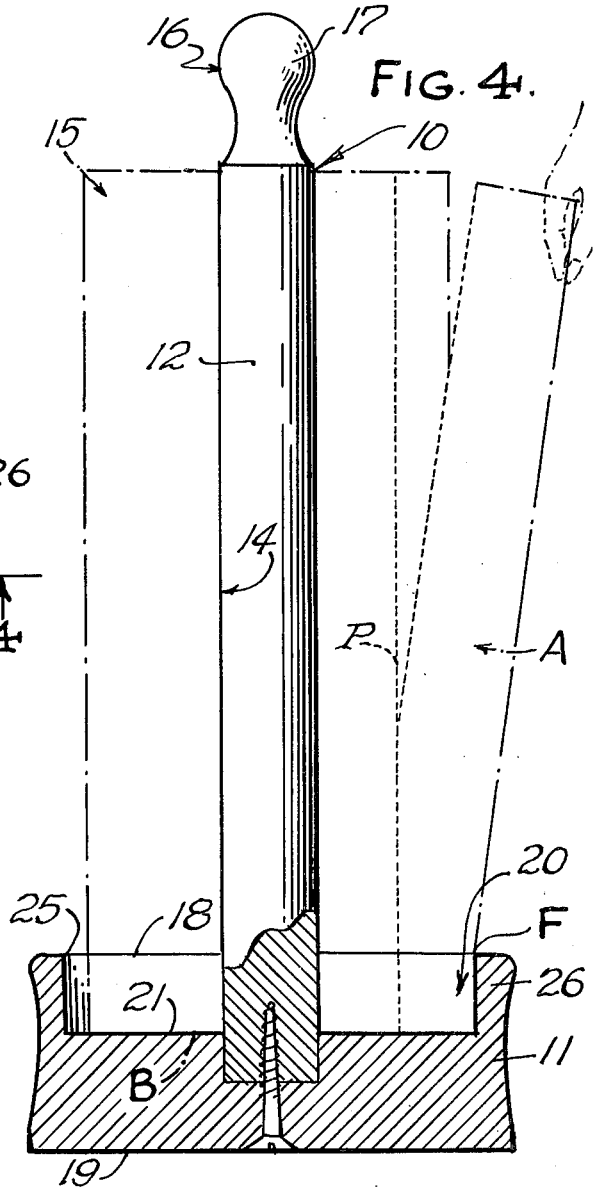
FIG. 4 is a section through FIG. 3 along line 4—4.
Figure 5:
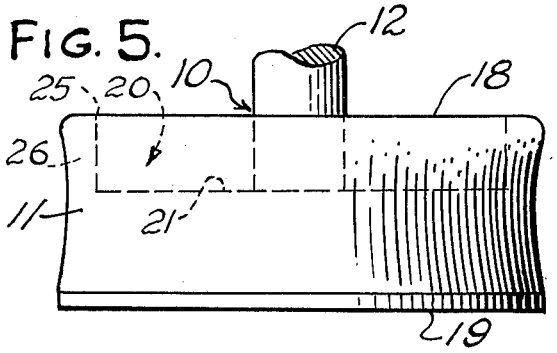
FIG. 5 is a side elevational view of the base only of FIG. 3.

The phenomenon is best illustrated in FIGS. 1 and 4 wherein a fulcrum point designated F is delineated as created where the bottom of the sheet of towelling A being torn off engages the edge 25 on the upper rim 26 of the base at an angle relative to the upper end of the line of perforations P of the connected sheets on the roll 11. By this arrangement it will be noted that by grasping the upper outer corner of the sheet A with one hand only, to hold the sheet A substantially tangent to the roll 15 the lower portion of such sheet engages the edge 25 on the rim 26 of the base sufficiently above the bottom edge B of the roll 15. Consequently, by manually exherting a slightly downward pull against the upper outer corner of the sheet A and about the fulcrum Point F the sheet A begins to become severed from the roll 15 at the uppermost perforations P. Once the separation thus occurs, the gradual separation of the sheet between successive perforations downwardly from top to bottom of the line P therein continues by the downward pull exherted by the hand gripping the upper outer corner of the sheet A. The degree of pull thus exherted is not great enough to tilt the holder 10 and roll of towelling 15 thereon out of its vertical disposition. Moreover, it is not to such a degree as to cause the free standing portable holder to move while the separation of a sheet of towelling from the roll 15 thereof takes place.

From the foregoing it will be appreciated that the holder 10 constructed in accordance with the present invention is free standing, portable and effective for supporting a roll of perforated paper towelling such that single sheets of towelling are detachable by grasping such sheet by one hand only in the manner above explained. In other words, no additional support other than the weight of the holder itself need be applied thereto during the tearing off of a single sheet from the roll of towelling held thereby.

While the structure disclosed indicates an assembly of the pole 12 with the base 11 it should be understood that they may be integral and monolythic in structure by being made of plastic or other material in a molded production.

Having described my new portable holder for a roll of perforated paper towels in speciic detail, it will be appreciated that the same may be susceptible to variation, modification and/or alteration without departing from the spirit or scope of my invention therein as called for in the appended claims.

I claim:

1. A free standing portable holder for supporting conventional perforated paper towelling rolled on a hollow core center and means for facilitating gradual tearing off of first or outer sheets of paper towel therefrom by manual gripping of the upper outer corner of such sheets by one hand only comprising:

1. a pedestal base adapted to rest upon a horizontal surface;
2. a pole extending upwardly from said base having a diameter adapted to fit within the hollow core of such roll of paper towelling for supporting the latter with its axis normal to the horizontal surface upon which said base rests;
3. an annular rim on the upper surface of said base and extending upwardly a distance substantially comparable to the diameter of said pole and concentric to said pole for circumscribing the lower portion of the roll of paper towelling thereon; and
4. an internal edge on the upper end of said annular rim engageable by the lower portion of a sheet of towelling extending tangentially from said roll in a spaced relation to the line of perforations between such sheet of towelling and the roll thereof for providing a fulcrum point for engaging such sheet at a sufficient distance above said base to facilitate separation of such sheet from the roll thereof between perforations therebetween, first at the upper end of the line of perforations and gradually downward from top to bottom of such perforations by a downward pull exherted manually upon the upper outer corner of such sheet.

2. The portable holder for a conventional roll of perforated paper towelling in accordance with claim 1 in which said base comprises a solid member having a recess formed in its upper surface to a depth substantially comparable to the diameter of said pole to provide the said annular rim thereon on said base concentric to said pole and to provide the said internal upper edge a substantial distance above the bottom edge of the roll of paper towelling supported on said base and pole.

3. The portable holder as defined in claim 1 including a knob formed on the upper end of said pole beyond the upper edge of a roll of paper towelling thereon providing a handle whereby the holder may be manually transported.

4. The portable holder as defined in claim 2 including a knob formed on the upper end of said pole beyond the upper edge of a roll of paper towelling thereon providing a handle whereby the holder may be manually transported.

* * * * *